US007197994B2

(12) United States Patent
Takahashi et al.

(10) Patent No.: US 7,197,994 B2
(45) Date of Patent: Apr. 3, 2007

(54) HORIZONTAL ROTARY HOOK FOR SEWING MACHINE

(75) Inventors: Masakazu Takahashi, Tochigi (JP); Shin Ota, Aichi (JP); Katsuhiro Kitajima, Gifu (JP); Toshio Abe, Aichi (JP)

(73) Assignees: E. I. du Pont de Nemours and Company, Wilmington, DE (US); Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/284,217

(22) Filed: Nov. 21, 2005

(65) Prior Publication Data

US 2006/0150879 A1 Jul. 13, 2006

(30) Foreign Application Priority Data

Nov. 24, 2004 (JP) ..... 2004-338539

(51) Int. Cl.
*D05B 57/26* (2006.01)
*D05B 57/00* (2006.01)

(52) U.S. Cl. ..... 112/185; 112/230

(58) Field of Classification Search ..... 112/185, 112/181, 187, 189, 196, 228, 230, 231
See application file for complete search history.

(56) References Cited

U.S. PATENT DOCUMENTS

| | | | | | |
|---|---|---|---|---|---|
| 2,716,956 | A * | 9/1955 | Parry | 112/230 |
| 3,139,050 | A * | 6/1964 | Grabowski | 112/38 |
| 4,660,487 | A * | 4/1987 | Mikuni | 112/230 |
| 4,966,088 | A * | 10/1990 | Badillo | 112/184 |
| 5,427,042 | A * | 6/1995 | Yamasaki | 112/230 |
| 5,617,803 | A * | 4/1997 | Badillo | 112/230 |

FOREIGN PATENT DOCUMENTS

| | | |
|---|---|---|
| JP | A-H07-31775 | 2/1995 |

* cited by examiner

*Primary Examiner*—Ismael Izaguirre
(74) *Attorney, Agent, or Firm*—Kevin S. Dobson

(57) ABSTRACT

The present invention is a horizontal rotary hook for a sewing machine includes an inner bobbin case holder, an outer rotating hook made of a synthetic resin, a sliding surface formed on the rotating hock so as to be slid relative to the bobbin case holder with rotation of the rotating hook while an outer periphery of the bobbin case holder is placed on the rotating hook, an opening defined in an outer peripheral wall of the rotating hook so that a needle thread passes through the opening, and a beak mounted on an outer peripheral wall of the rotating hook for seizing a loop of the needle thread.

14 Claims, 12 Drawing Sheets

HORIZONTAL ROTARY HOOK FOR SEWING MACHINE

CROSS-REFERENCE TO RELATED APPLICATIONS

This application is based upon and claims the benefit of priority from the prior Japanese Patent Application No. 2004-338539, filed on Nov. 24, 2004, the entire contents of which are incorporated herein by reference.

TECHNICAL FIELD

The disclosure relates to a horizontal rotary hook for a sewing machine which includes an inner bobbin case holder for accommodating a bobbin and an outer rotating hook which is made of a synthetic resin and rotated in a predetermined direction while accommodating the bobbin case holder.

BACKGROUND

A horizontal rotary hook providing an easy replacement of a bobbin has conventionally been used in sewing machines. The horizontal rotary hook comprises an outer rotating hook having an annular sliding surface formed on an upper surface of outer peripheral wall thereof and an inner bobbin case holder accommodating a thread bobbin therein and supported in the rotating hook so as to be rotatable relative to the sliding surface. The rotating hook is adapted to be rotated in a predetermined direction by a sewing machine motor or the like while the bobbin case holder is prevented from rotation relative to a sewing bed of the sewing machine.

The bobbin case holder is made of a synthetic resin so that a reduction is achieved in the weight and production cost thereof. Furthermore, the rotating hook has also been made of a synthetic resin recently. In this case, a beak is provided on an outer peripheral wall of the rotating hook for seizing a loop of bobbin thread. A beak member constituting the beak has been proposed to be separated from a rotating hook body. For example, JP-A-H07-31775 discloses a horizontal rotary hook in which a beak member is made of a metal, is separate from the rotating hook and is mounted on an inner peripheral surface of an outer peripheral wall of the rotating hook made of the synthetic resin. Furthermore, the beak member has also been proposed to be made of a synthetic resin for the purpose of further reduction in the production cost.

However, a high dimensional accuracy cannot always be obtained when the beak member is made of a synthetic resin by injection molding. As a result, there is a possibility that the beak member may collide against a protrusion such as a thread guide of the bobbin case holder during rotation of the rotating hook and accordingly, the rotating hook may not be rotated smoothly. In view of this problem, when the beak member is made of a synthetic resin, fine finishing such as cutting and/or polishing is necessitated for the beak after the molding of the beak member. Thus, the production cost cannot effectively be reduced.

SUMMARY

Therefore, an object of the disclosure is to provide a horizontal rotary hook for a sewing machine, in which a beak member of the rotating hook can be prevented from collision against the bobbin case holder so that a smooth rotation of the rotating hook can be ensured and the production cost can be reduced.

In one aspect, the disclosure provides a horizontal rotary hook for a sewing machine which includes an inner bobbin case holder accommodating a bobbin and having an outer periphery and an outer rotating hook made of a synthetic resin, having an outer peripheral wall and rotated in a predetermined direction while accommodating the bobbin case holder. The horizontal rotary hook comprises a sliding surface provided on the rotating hook so as to be slid relative to the bobbin case holder with rotation of the rotating hook while the outer periphery of the bobbin case holder is placed on the rotating hook, the sliding surface having an outer peripheral sides an opening provided in the outer peripheral wall of the rotating hook so that a needle thread passes therethrough; and a beak provided on the outer peripheral wall of the rotating hook for seizing a loop of the needle thread, the beak including a beak peripheral wall having a distal end located at a forward side of the beak peripheral wall with respect to a rotation direction of the rotating hook, the distal end facing the opening, the beak peripheral wall being located at the outer peripheral side of the sliding surface, the beak further including a beak body formed integrally with the beak peripheral wall and protruding inward from the beak peripheral wall so as to be located in the vicinity of a lower part of the sliding surface, the beak peripheral wall having an inner peripheral surface of the distal end thereof formed with an inclined surface inclined forwardly outward with respect to the rotation direction of the rotating hook.

There is a possibility that a protrusion of the bobbin case holder may collide against the distal end of the beak peripheral wall from the inner peripheral side during rotation of the rotating hook when the distal end of the beak peripheral wall of the rotating hook has an insufficient dimensional accuracy. In the disclosure, however, an inner peripheral surface of the distal end of the beak peripheral wall is formed with an inclined surface inclined forwardly outward with respect to the rotation direction of the rotating hook. Accordingly, even when the beak has a slightly insufficient dimensional accuracy, the protrusion of the bobbin case holder can effectively be prevented from collision against the distal end of the beak peripheral wall. Consequently, the collision of the beak against the bobbin case holder can be prevented without fine finishing of the beak of the rotating hook. Thus, the beak can be made of a synthetic resin and accordingly, the production cost can be reduced.

In another aspect, the disclosure provides a horizontal rotary hook for a sewing machine which includes an inner bobbin case holder accommodating a bobbin and having an outer periphery and an outer rotating hook made of a synthetic resin, having an outer peripheral wall and rotated in a predetermined direction while accommodating the bobbin case holder. The horizontal rotary hook comprises a sliding surface provided on the rotating hook so as to be slid relative to the bobbin case holder with rotation of the rotating book while the outer periphery of the bobbin case holder is placed on the rotating hook, the sliding surface having an outer peripheral side; an opening provided in the outer peripheral wall of the rotating hook so that a needle thread passes therethrough; and a beak provided on the outer peripheral wall of the rotating hook for seizing a loop of the needle thread, the beak including a beak peripheral wall having a distal end located at a forward side of the beak peripheral wall with respect to a rotation direction of the rotating hook, the distal end facing the opening, the beak peripheral wall being located at the outer peripheral side of the sliding surface, the beak further including a beak body formed integrally with the beak peripheral wall and protruding inward from the beak peripheral wall so as to be located in the vicinity of a lower part of the sliding surface, the beak body having a distal end including an upper face formed with an inclined surface inclined forwardly downward with respect to the rotation direction of the rotating hook.

There is a possibility that an outer peripheral end of the bobbin case holder (a part placed on the sliding surface) may collide against the distal end of the beak body during rotation of the rotating hook when the distal end of the beak peripheral wall of the rotating hook has an insufficient dimensional accuracy. In the disclosure, however, an inner peripheral surface of the distal end of the beak peripheral wall is formed with an inclined surface inclined forwardly outward with respect to the rotation direction of the rotating hook. Accordingly, even when the beak has a slightly insufficient dimensional accuracy, the protrusion of the bobbin case holder can effectively be prevented from collision against the distal end of the beak peripheral wall. Consequently, the collision of the beak against the bobbin case holder can be prevented without fine finishing of the beak of the rotating hook. Thus, the beak can be made of a synthetic resin and accordingly, the production cost can be reduced.

In one embodiment, the beak peripheral wall is formed integrally with the outer peripheral wall of the rotating hook. Furthermore, the beak member including the beak peripheral wall and the beak body is separate from the rotating hook and detachably attached to the rotating hook.

When the beak member is a separate component which is mounted on the outer peripheral wall of the rotating hook so as to be located in the enlarged opening, there is a possibility that a protrusion of the bobbin case holder may collide against the inner peripheral edge facing the enlarged opening during rotation of the rotating hook. In view of this problem, the outer peripheral wall of the rotating hook has an inner peripheral edge facing the enlarged opening and formed with another inclined surface inclined forwardly outward with respect to the rotation direction of the rotating hook. Consequently, the aforesaid collision of the bobbin case holder against the inner peripheral edge can be prevented effectively.

Furthermore, there is a possibility that the outer peripheral end of the bobbin case holder may collide against a distal end of the sliding surface facing the enlarged opening during rotation of the rotating hook. In view of this problem, the sliding surface has a distal end facing the enlarged opening and formed with another inclined surface inclined forwardly downward with respect to the rotation direction of the rotating hook. Consequently, the aforesaid collision of the bobbin case holder against the inner peripheral edge can be prevented effectively.

The horizontal rotary hook includes a half rotary hook in which a rotating hook is repeatedly rotated in normal and reverse directions alternately, as well as a full rotary hook in which a rotating hook is rotated in a direction. In the horizontal half rotary hook, there is a possibility that a protrusion of the bobbin case holder may collide against an inner peripheral edge of the beak peripheral wall located at a rearward side of the inner peripheral edge with respect to the rotation direction of the rotating hook during reverse rotation of the rotating hook. In view of this problem, the beak peripheral wall includes an inner peripheral edge located at a rearward side thereof with respect to the rotation direction of the rotating hook and formed with another inclined surface inclined forwardly outward with respect to the rotation direction of the rotating hook. Consequently, the aforesaid collision of the bobbin case holder against the inner peripheral edge can be prevented effectively.

Furthermore, there is a possibility that the outer peripheral end of the bobbin case holder may collide against an end of the beak body located at a rearward side of the beak body with respect to a rotation direction of the rotating hook during reverse rotation. In view of this problem, the beak body has an end located at a rearward side thereof with respect to the rotation direction of the rotating hook, the end having an upper face formed with another inclined surface inclined rearwardly downward with respect to the rotation direction of the rotating hook. Consequently, the aforesaid collision of the bobbin case holder against the end of the beak body can be prevented effectively.

Whether the beak member is a separate or integral component, there is a possibility that a protrusion of the bobbin case holder may collide, during reverse rotation of the rotating hook, against an inner peripheral edge of the outer peripheral wall of the rotating hook facing a forward side of the opening with respect to the rotation direction of the rotating hook. Furthermore, there is a possibility that an outer peripheral end of the bobbin case holder may collide against an end of the sliding surface facing a forward side of the opening with respect to the rotation direction of the rotating hook. In view of these problems, the inner peripheral edge of the outer peripheral wall of the rotating hook is formed with another inclined surface inclined rearwardly outward with respect to the rotation direction of the rotating hook, and the aforesaid end of the sliding surface is formed with further another inclined surface inclined rearwardly outward with respect to the rotation direction of the rotating hook.

In further another aspect, the disclosure provides a horizontal rotary hook in which the beak peripheral wall having an inner peripheral surface of the distal end thereof formed with a first inclined surface inclined forwardly outward with respect to the rotation direction of the rotating hook, the beak body having a distal end including an upper face formed with a second inclined surface inclined forwardly downward with respect to the rotation direction of the rotating hook. Consequently, the collision of the beak of the rotating hook against the bobbin case holder can be prevented effectively.

BRIEF DESCRIPTION OF THE DRAWINGS

Other objects, features and advantages of the present invention will become clear upon reviewing the following description of the illustrative aspects with reference to the accompanying drawings, in which.

DETAILED DESCRIPTION OF THE INVENTION

Several embodiments of the invention will be described with reference to the accompanying drawings. FIGS. 1A to 12 show a first embodiment of the invention. The invention is applied to a horizontal full rotary hook in which an outer rotating hook is continuously rotated in one direction (in the direction of arrow A).

Figure 1A:
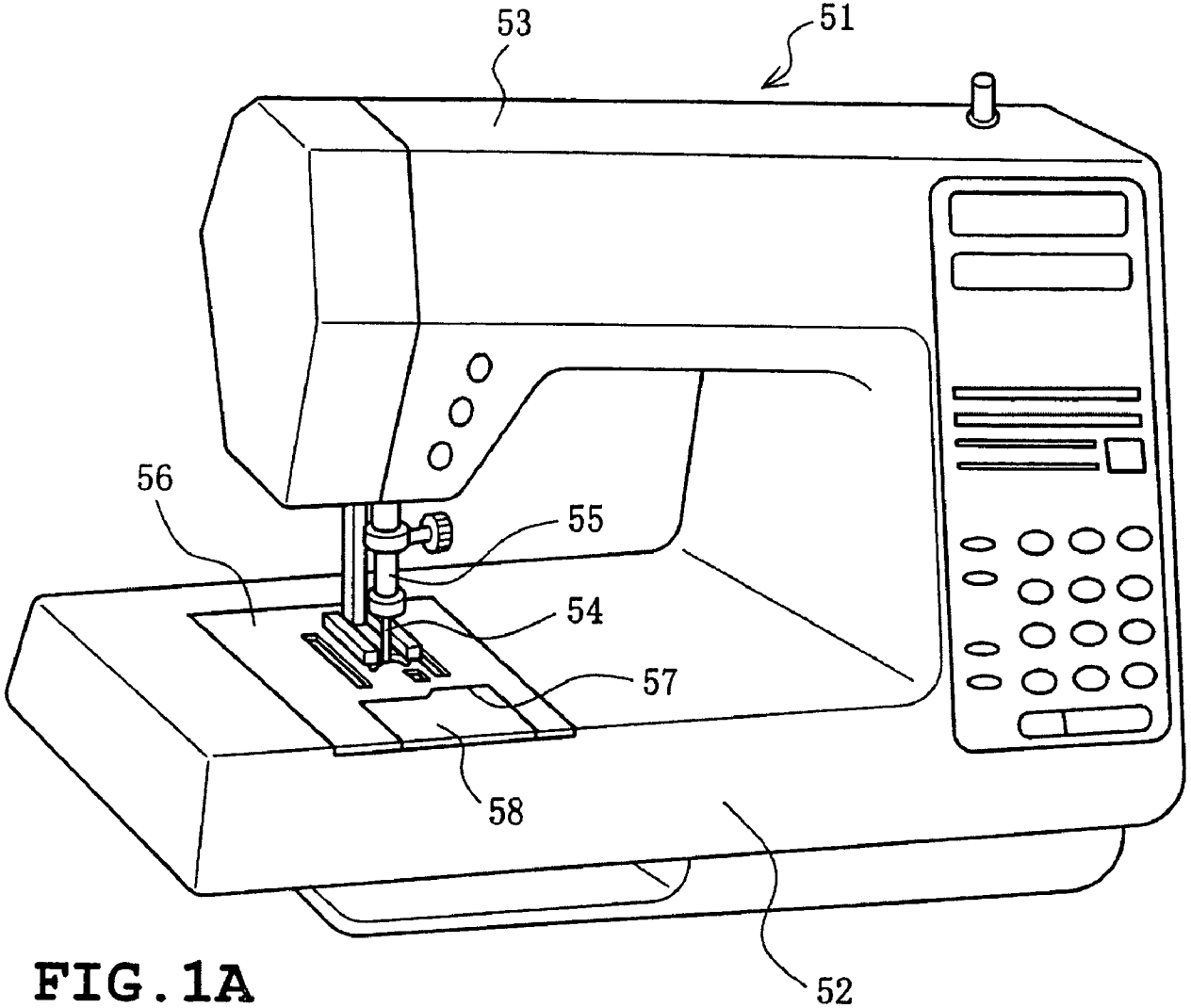
FIG. 1A is a perspective view of a sewing machine according to a first illustrative aspect of the invention.
Figure 1B:
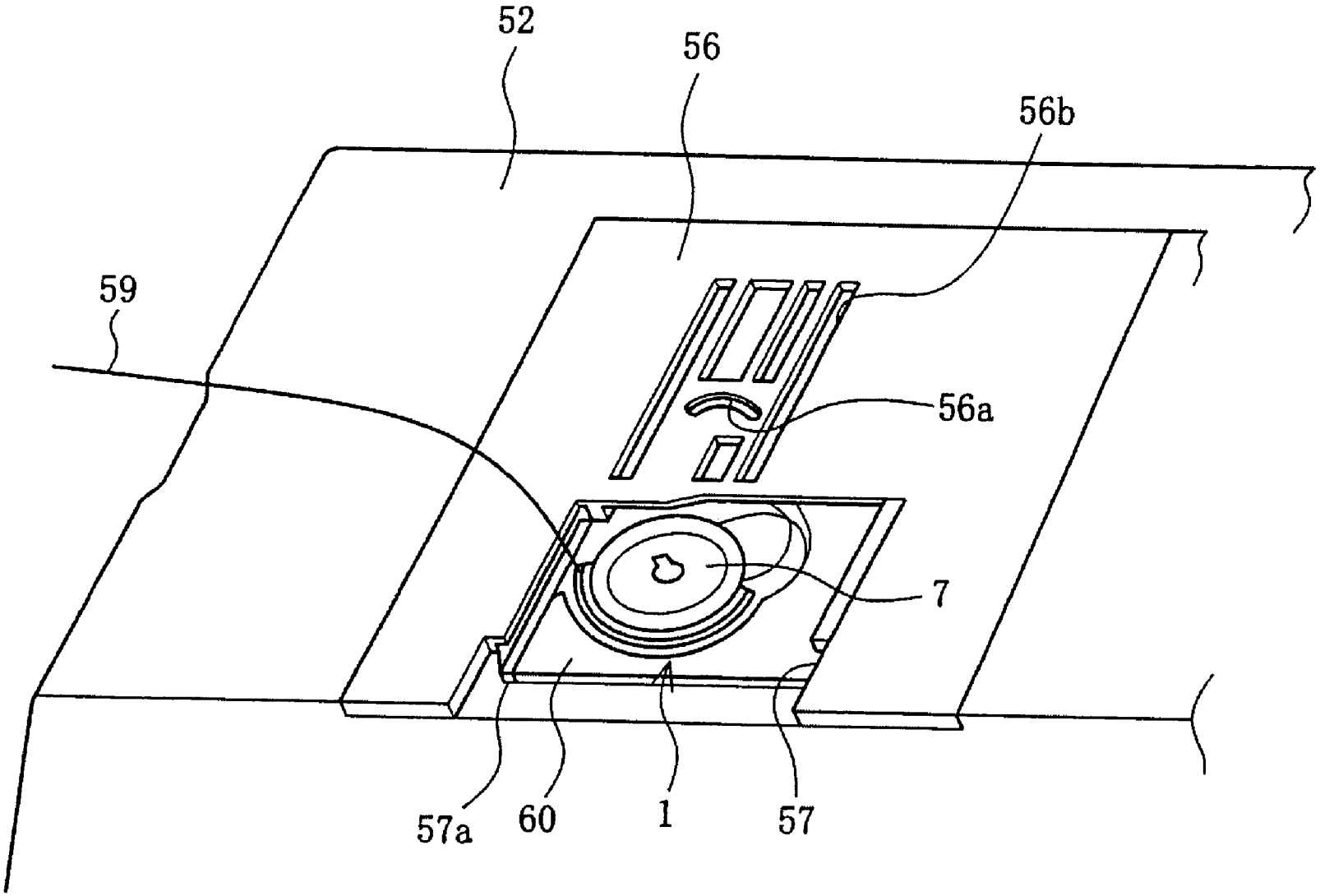
FIG. 1B is an enlarged perspective view of a needle plate.

Firstly, an overall construction of the sewing machine will be described. The sewing machine comprises a body 51 including a sewing bed 52 and a sewing arm 53 formed integrally with the bed so as to be mounted over the bed as shown in FIG. 1A. The arm 53 has a distal end having a needle bar 55 provided with a sewing needle 54. A needle bar 55 is moved vertically by a driving mechanism (not shown). On the other hand, a metal needle plate 56 is mounted on an upper surface of the bed 52 so as to be opposed to the needle bar 55 as shown in FIG. 1B. The needle plate 56 has a needle hole through which the needle 54 passes and a plurality of elongate slits 56*b* for actuation of a feed dog (not shown). Further, the needle plate 56 has a rectangular bobbin-accommodating hole 57 located in front of the needle hole 56*a* and the elongate slits 56*b*. The bobbin-accommodating hole 57 has two slide grooves 57*a* formed in right and left portions thereof (only the left slide groove being shown) respectively. A transparent slide lid 58 (see FIG. 1A) is adapted to be inserted into the grooves 57*a* so as to be slidable front and back, thereby closing and opening the bobbin-accommodating hole 57.

A cloth feed mechanism (not shown) is provided inside the bed 52 for driving the feed dog in synchronization with the vertical movement of the needle bar 55. Further, a horizontal full rotary hook 1 of the embodiment is located below the bobbin-accommodating hole 57. The horizontal full rotary hook 1 includes a beak member 5 and an outer rotating hook 3 (see FIG. 2) horizontally rotated in synchronization with the vertical movement of the needle bar 55 and an inner bobbin case holder 2 (see FIG. 2). A bobbin 7 on which a bobbin thread 59 is wound is detachably accommodated in the inner rotating hook bobbin case holder 2 as shown in FIG. 1B. A plastic presser plate 60 is mounted on the underside of the needle plate 56 so as to be located in the bobbin-accommodating hole 57. The presser plate 60 has an opening through which the bobbin 7 is put into and taken out of the bobbin case holder 2. The presser plate 60 further has an engagement portion (not shown) formed on the underside thereof for engaging a rotation limiter 12 of the bobbin case holder 2, which limiter 12 will be described later.

In the sewing machine thus constructed, when the rotating hook 3 is rotated counterclockwise in synchronization with the vertical movement of the needle bar 55, a loop of needle thread (not shown) formed by a sewing needle 54 below an eye 56*a* of the sewing needle is caught by a loop seizing beak member 5. This direction of rotation will hereinafter be referred to as "hook rotating direction A." The thread loop is then entangled with the bobbin thread 59 while being passed outside the bobbin case holder 2, whereby a stitch is formed.

Figure 2:
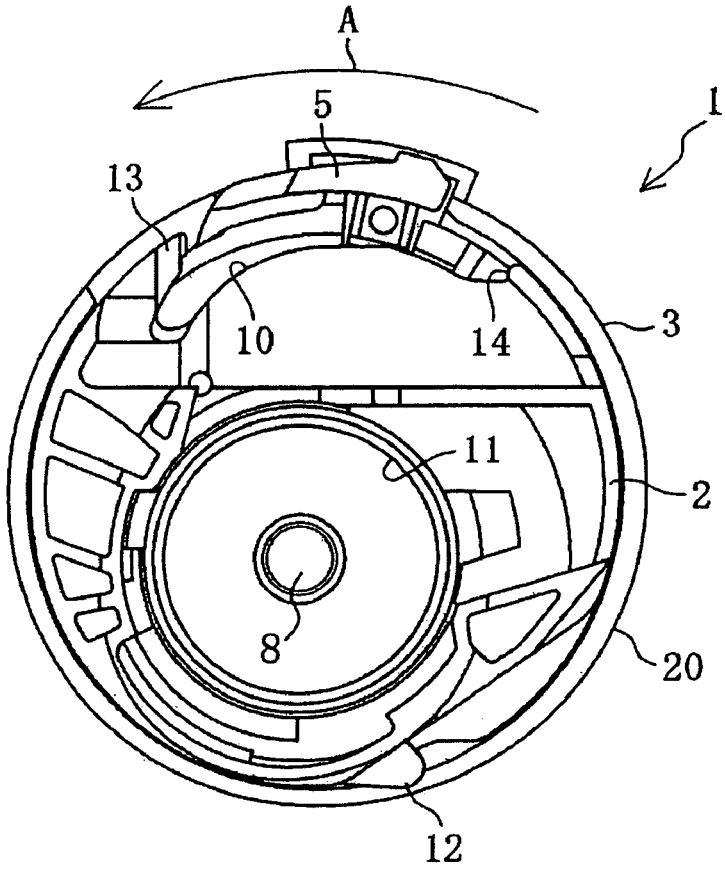
FIG. 2 is a plan view of a horizontal rotary hook.
Figure 3:
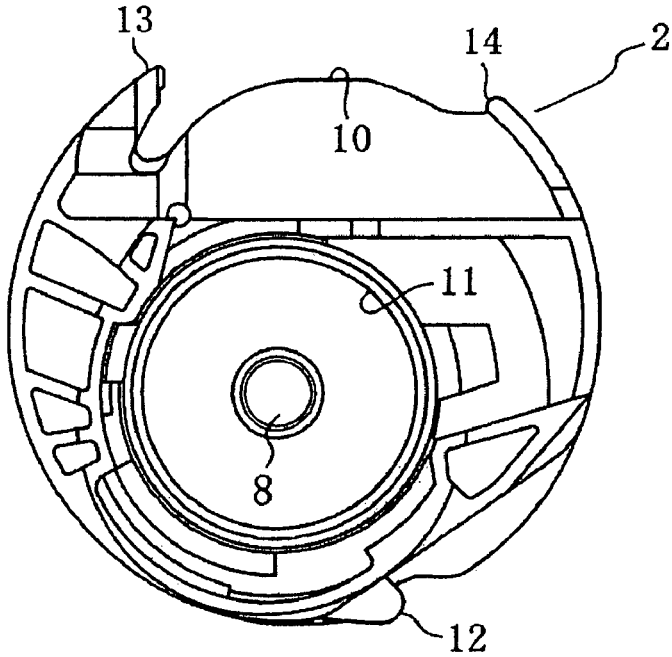
FIG. 3 is a plan view of an inner bobbin case holder.
Figure 4:
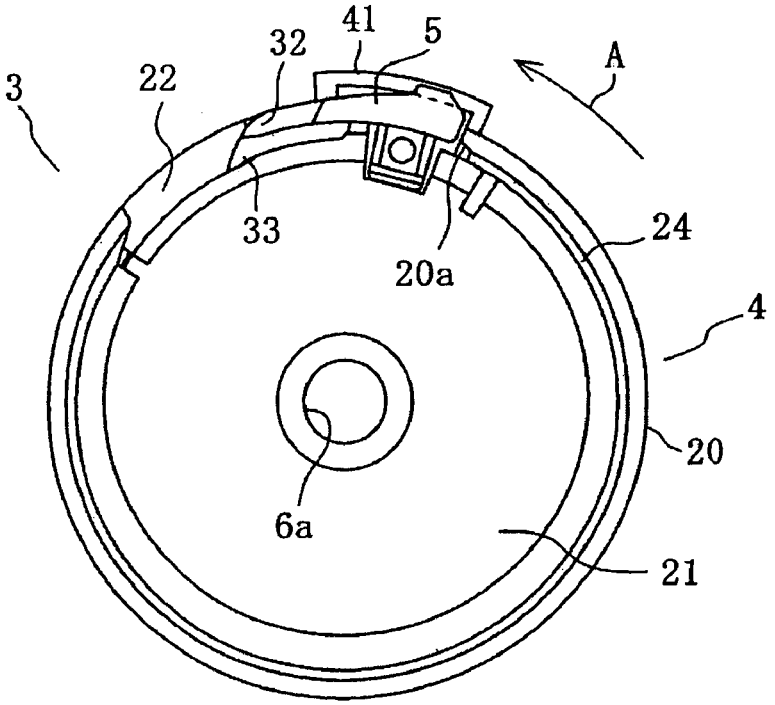
FIG. 4 is a plan view of an outer rotating hook.

The horizontal full rotary hook 1 will now be described in detail with reference to FIGS. 2 to 12. The bobbin case holder 2 will first be described. Referring to FIGS. 2, 3 and 12, the bobbin case holder 2 is made of a synthetic resin such as nylon resin and formed into the shape of a substantially cylindrical shallow container. An interior of the bobbin case holder 2 serves as a bobbin-accommodating section 11 for accommodating the bobbin 7. The bobbin case holder 2 has a bottom with a centrally formed shaft 8 with which the bobbin 7 is to be fitted.

Referring to FIGS. 2 and 3, the bobbin case holder 2 includes an outer periphery formed with the rotation limiter 12 located at the front as viewed in FIG. 3 and preventing rotation of the bobbin case holder 2. The outer periphery of the bobbin case holder 2 is further formed with a notch 10 located at an inner side as viewed in FIG. 3 and allowing the needle 54 to pass through the notch. The notch 10 has one end formed with a protruding thread guide 13. The thread guide 13 engages the needle thread loop seized by the beak member 5, guiding the needle thread below the bobbin case holder 2. The other end of the notch 10 will be referred to as "notch end 14."

The outer peripheral end of the bobbin case holder 2 except for the notch 11 and the rotation limiter 12 is formed into the shape of a ring and has an underside adapted to be slidably placed on a sliding surface 24 which will be described later, although the construction is not shown in the drawings. The bobbin-accommodating section 11 has an inner wall provided with a tensioning member (not shown) for tensioning a bobbin thread 59. The tensioning member comprises a thread tension bracket and a tension spring both of which are formed into an arc-shaped plate and mounted on the inner wall of the bobbin-accommodating section 11 in a superposed state.

Figure 5:
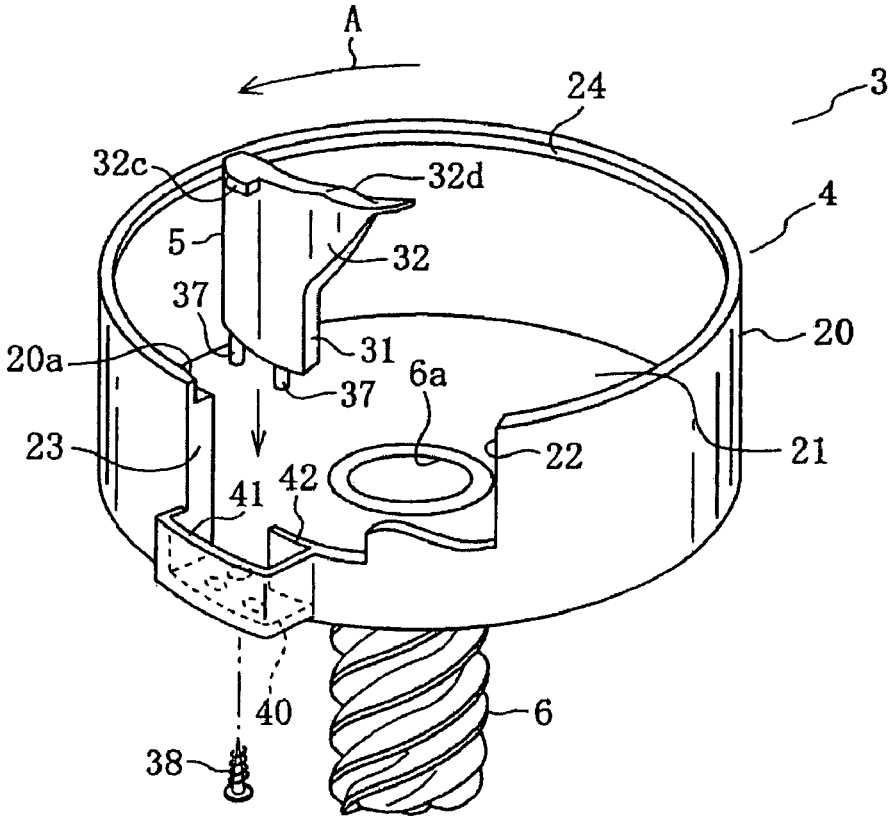
FIG. 5 is a perspective view of the rotating hook with a beak member being shown in an exploded state.
Figure 6:
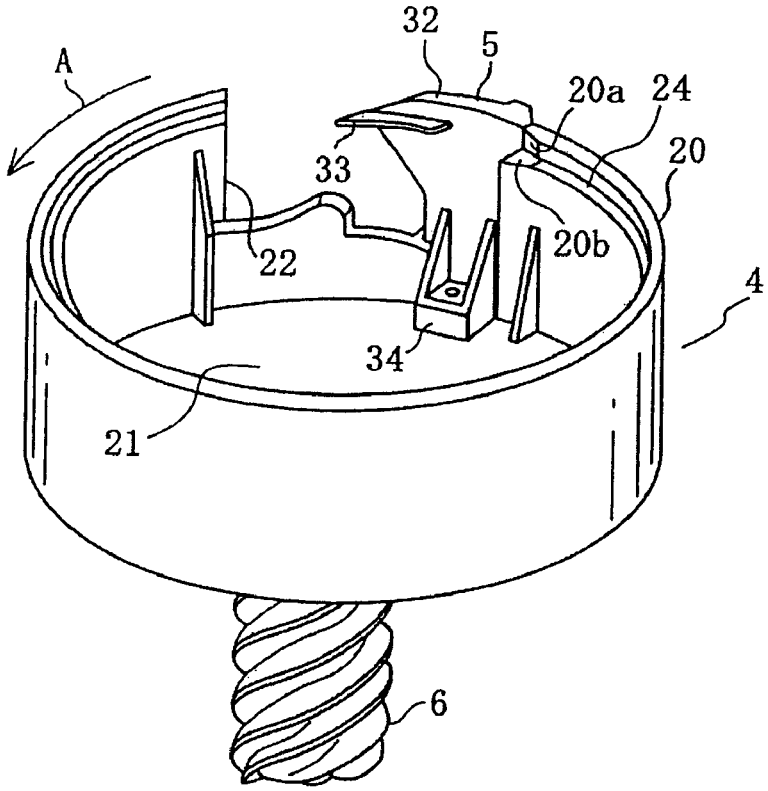
FIG. 6 is a perspective view of the rotating hook as taken from an angle different from FIG. 6.

Next, the rotating hook 3 will be described. Referring to FIGS. 5 and 6, the rotating hook 3 includes a cylindrical receptacle-shaped hook body 4 having an open top, a beak member 5 to be mounted on the hook body 4 and a drive shaft 6 extending downward from the central underside of the hook body 4. In the embodiment, the hook body 4 and the drive shaft 6 are each made of a synthetic resin such as nylon resin and are formed integrally with each other, for example, by injection molding. The beak member 5 is made of a synthetic resin such as polyimide resin. The material of the beak member 5 has a higher hardness than the material of the hook body 4.

Figure 7:
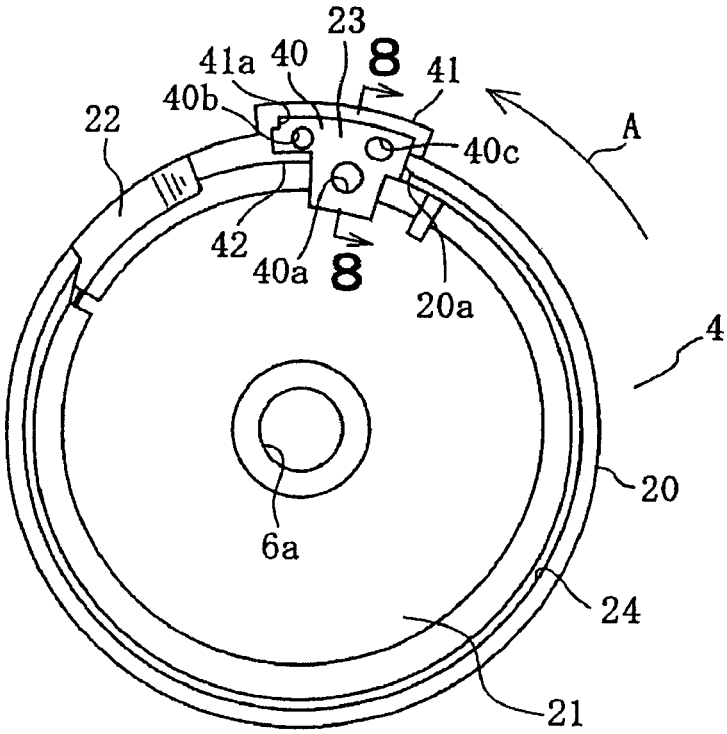
FIG. 7 is a view similar to FIG. 4, showing the condition before a beak member is attached to the rotating hook.

The hook body 4 has a disc-shaped bottom 21 and an outer peripheral wall 20 which is formed integrally with the bottom so as to rise from an outer circumference of the bottom. The hook body 4 has a slightly larger diameter than the bobbin case holder 2. The outer peripheral wall 20 includes a part formed into a needle thread passing opening 22 through which a needle thread seized by the beak member 5 passes, as shown in FIGS. 5 to 7. The wall 20 is further formed with an enlarged opening 23 (see FIG. 5) which is continuous to the side of the opening 22 opposed to the rotation direction A of the rotating hook and into which the beak member 5 is attached.

Referring now to FIGS. 4 to 7 and 10, the outer peripheral wall 20 has an upper end formed with an annular sliding surface 24 which is located at the inner peripheral side and is lower by one step than the top except for the openings 22 and 23. The bobbin case holder 2 has a lower end placed on the sliding surface 24 so as to be slidable thereon as shown in FIGS. 2 and 12, whereupon the bobbin case holder 2 is adapted to be accommodated in the rotating hook 3 while floating slightly away from the bottom 21. Dashed line K in FIGS. 10 and 11 designates a movement locus of the lower end of the outer periphery of the bobbin case holder 2 sliding on the sliding surface 24.

Referring now to FIGS. 5 and 6, the drive shaft 6 is formed into the shape of a pipe and has a shaft hole 6*a* (See FIG. 5) vertically extending therethrough. The drive shaft 6 further has a worm-gear-like gear formed on the outer circumference thereof. A rotating hook shaft (not shown) is adapted to be inserted through the shaft hole 6*a*. The rotating hook shaft has a lower end fixed to a sewing machine frame (the bottom of the bed 52), thereby rotatably supporting the rotating hook 3. The gear of the drive shaft 6 is brought into mesh engagement with a driving gear of a hook driving mechanism (not shown) so that the rotating hook 3 is rotated via the aforesaid driving gear and drive shaft 6 in the hook rotating direction A.

The beak member 5 is a component separate from the hook body 4 and is detachably attached to the hook body 4 in the embodiment. A mounting structure for the beak member 5 will be described in detail. The construction of the beak member 5 will firstly be described. The beak member 5 has a height equal to that of the outer circumferential wall 20 and is formed into the shape of a plate curved at the same curvature as the wall 20 as viewed from above, as shown in FIGS. 5 and 9 to 11. The beak member 5 is sized so as to close the aforesaid enlarged opening 23. The beak member 5 has substantially a lower half serving as a support wall 31 and an upper half serving as a beak peripheral wall 32 located at the outer periphery side of the lace 24.

Figure 11:
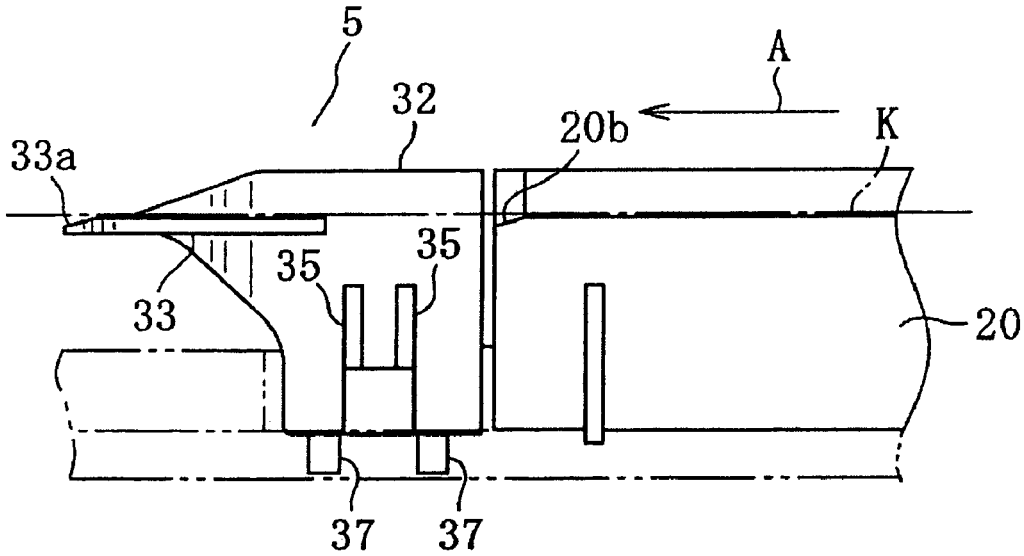
FIG. 11 is a view as viewed in the direction of arrow J in FIG. 10.
Figure 12:
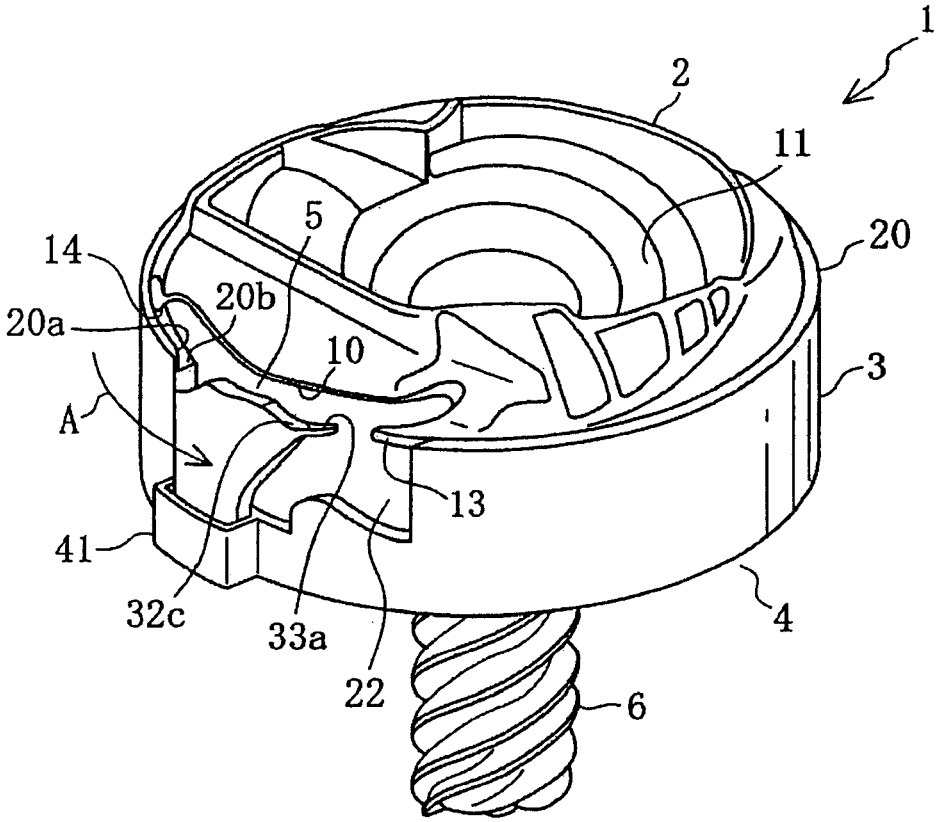
FIG. 12 is a perspective view of the horizontal rotary hook.

The beak peripheral wall 32 has an upper face including a forward side with respect to a rotation direction A of the rotating hook as shown in FIG. 11. A guide face 32*d* is formed on the forward side of the upper face of the beak peripheral wall 32. The beak peripheral wall 32 further has a rearward side upper end formed with an outwardly protruding thread engagement step 32*c* as shown in FIG. 5. The thread engagement step 32*c* is provided for engaging and locking the needle thread loop.

The beak peripheral wall 32 also has an inner periphery including a horizontal thin plate-shaped beak body 33 formed integrally with the wall 32 so as to be located near to the lower side of the lace 24 (the side lower than the chain line K) as shown in FIGS. 4, 6 and 9 to 11. The beak body 33 has a forward side end with respect to the rotation direction A of the rotating hook. The forward side end of the beak body 33 is formed so as to extend toward the forward side by a predetermined dimension and so as to protrude inward. The beak peripheral wall 32 and beak body 33 constitute the thread capturing beak. Furthermore, two positioning pins 37 extend downward from the underside of the support wall 31 of the beak member 5 as shown in FIGS. 5 and 11.

Figure 9:
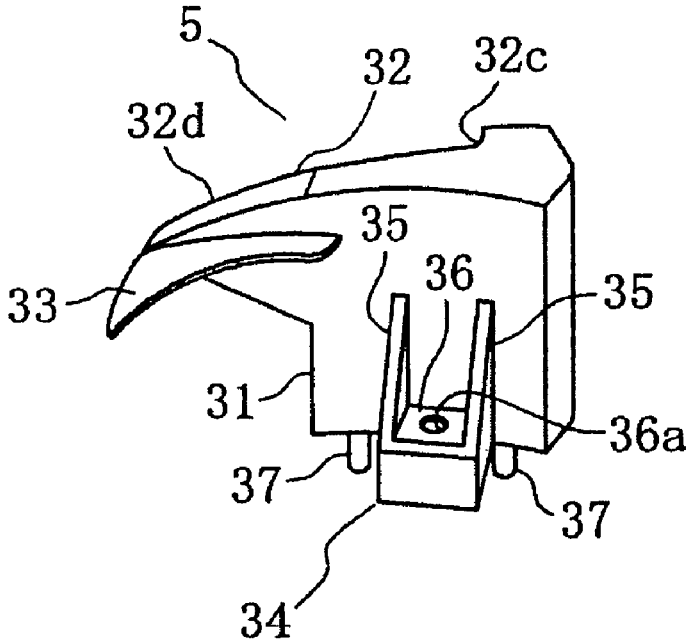
FIG. 9 is a perspective view of the beak member.

A fixing block 34 is integrally formed on the inner periphery of the support wall 31 as shown in FIG. 9. The fixing block 34 includes a bottom 36 mounted on the lower end of the support wall 31 and a pair of substantially triangular side walls 35 extending from opposite ends of the bottom 36. The bottom 36 is formed into a rectangular shape and has a centrally located fixing screw hole 36*a*.

Figure 8:
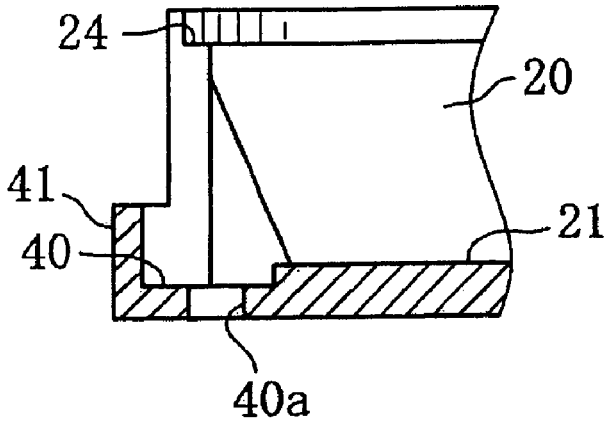
FIG. 8 is a view taken along line 8—8 in FIG. 7.

On the other hand, the hook body 4 is provided with a fitting holder 43 for holding the beak member 5. The fitting holder 43 includes a reinforcing peripheral wall 41 protruding outward from the outer peripheral wall 20 of the hook body 4 and supporting a lower outer face of the beak member 5 as shown in FIGS. 7 and 8. The fitting holder 43 further includes a reinforcing bottom 40 which is continuous to the bottom 21 and constitutes the bottom of the fitting holder 43. Furthermore, the reinforcing peripheral wall 41 has an end having an inner reinforcing wall 42 which is formed adjacent to the inner face of the beak member 5 so as to be parallel with the reinforcing peripheral wall 41. Each of the peripheral walls 41 and 42 has a height set to about one third of the height of the outer peripheral wall 20, for example. The reinforcing peripheral wall 41 has both ends continuous to the outer peripheral wall 20. Furthermore, the reinforcing peripheral wall 41 has a corner located at the forward side with respect to the rotation direction A of the rotating hook as shown only in FIG. 7. A columnar corner support 41*a* is formed on the corner so as to be located at the reinforcing bottom 40 side. Thus, the corner support 41*a*, reinforcing peripheral wall 41 and inner reinforcing wall 42 are abutted against the upwardly inserted beak member 5, thereby holding the beak member 5 in a vertical position.

On the other hand, the reinforcing bottom 40 continuous to the bottom 21 is formed into a generally T-shape as viewed on a plane so as to be located slightly lower than the bottom 21. The reinforcing bottom 40 has a screw hole 40*a* formed an inner part thereof so that the screw hole 40*a* corresponds to the screw hole 36*a* of the fixing block 34 of the beak member 5. The reinforcing bottom 40 further has a circular pin hole 40*b* for positioning the beak member 5 and an elongate circular pin hole 40*c* which is slightly longer laterally than the pin hole 40*b*. The pin holes 40*b* and 40*c* are formed so as to correspond to the aforesaid two positioning pins 37 respectively.

The beak member 5 is mounted on the hook body 4 in the manner as described below. More specifically, the beak member 5 is inserted into the fitting holder 43 from above. In this case, the two positioning pins 37 formed on the lower end of the beak member 5 are inserted into the pin holes 40*b* and 40*c* formed in the reinforcing bottom 40 respectively, thereby being positioned. The pin hole 40*c* is slightly longer laterally than the pin hole 40*b*. Accordingly, even if the distance between the positioning pins 37 has a dimensional error, the error can be absorbed by the elongate pin hole 40*c*.

The fixing screw 38 is inserted through the screw hole 40*a* from below and screwed into the screw hole 36*a* of the fixing block 34 (see FIG. 5), whereby the beak member 5 is adapted to be fixed to the hook body 5. Consequently, the beak member 5 is mounted stably and reliably while being reinforced by the peripheral walls 41 and 42. Only the beak member 5 can individually be replaced easily if occasion arises.

Figure 10:
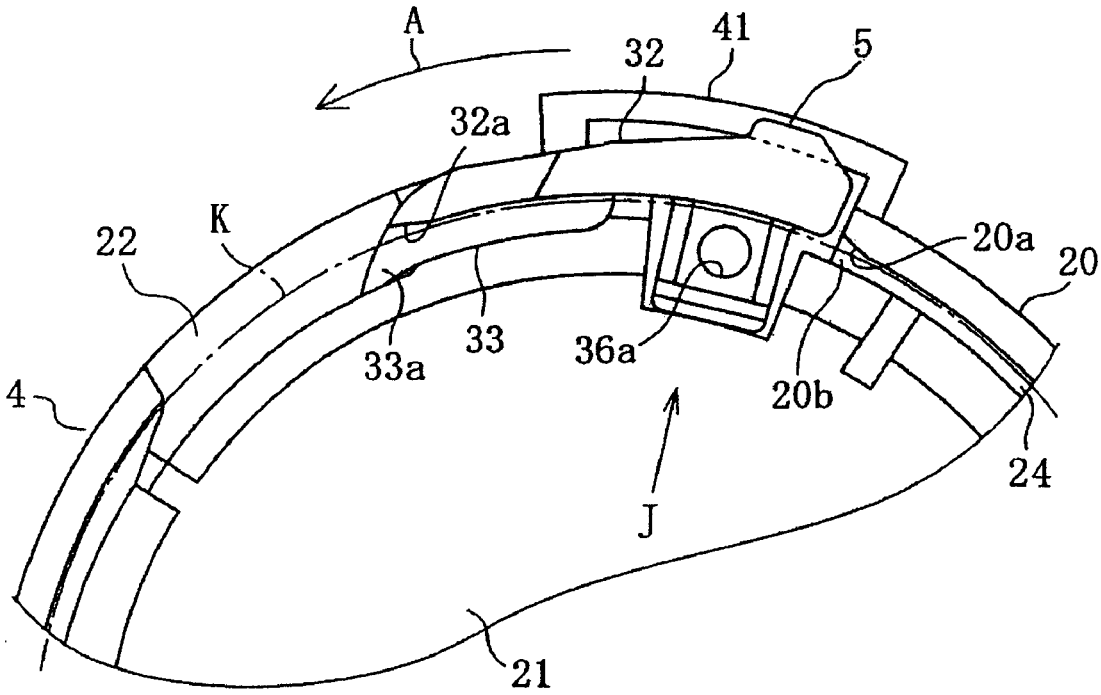
FIG. 10 is an enlarged plan view of the beak.

First to fourth inclined surfaces 32*a*, 33*a*, 20*a* and 20*b* are adapted to be formed on the beak member 5 and the outer peripheral wall 20 of the hook body 4 in order to avoid collision of the beak member 5 and the outer peripheral wall 20 against the rotation limiter 12 of the beak member 5 and the thread guide 13. More specifically, as shown in FIG. 10, the first inclined face 32*a* is formed on a forward end of the beak peripheral wall 32 with respect to the rotation direction A of the rotating hook 3. The first inclined face 32*a* is inclined forwardly outward. Furthermore, the second inclined face 33*a* is formed on a forward end of the beak body 33 with respect to the rotation direction A of the rotating hook 3 as shown in FIG. 11. The second inclined face 33*a* is inclined forwardly downward.

On the other hand, the third inclined face 20*a* is formed on an inner peripheral edge of the outer peripheral wall 20 fronting to the enlarged opening 23 and the beak member 5 as shown in FIGS. 6 and 10. The third inclined face 20*a* is gently inclined forwardly outward. Furthermore, as shown in FIGS. 6 and 11, the fourth inclined face 20*b* is formed on a forward edge of the lace 24. The fourth inclined face 20*b* is inclined forwardly downward.

These first to fourth inclined surfaces 32*a*, 33*a*, 20*a* and 20*b* are formed by the injection molding of the beak member 5 and hook body 4, that is, are not formed by a subsequent process. The bobbin case holder 2 can smoothly be slid on the sliding surface 24 as the result of formation of the inclined surfaces 32*a*, 33*a*, 20*a* and 20*b*.

An operation and effect of the horizontal rotary hook constructed above will now be described. The bobbin case holder 2 is set on the sliding surface 24 of the rotating hook 3 including the hook body 4 to which the beak member 5 has been assembled. In this state, when the rotating hook 3 is rotated in the rotation direction A by the hook driving mechanism in the sewing, the bobbin case holder 2 is rotated relative to the rotating hook 3 while being supported on the sliding surface 24 as shown in FIG. 11.

Since the beak member 5 is made of a synthetic resin by the injection molding and separately mounted on the hook body 4, there is a case where a sufficient dimensional accuracy and mounting position accuracy cannot be achieved unless an especially fine finishing process is carried out. As a result, there is a possibility that a protrusion of the bobbin case holder 2, that is, the rotation limiter 12 or thread guide 13 may collide against the distal end of the beak peripheral wall 32 or the distal end of hook body 33 during rotation of the rotating hook 3.

In the embodiment, however, the first inclined surface 32*a* is formed on the forward side end of the beak peripheral wall 32 with respect to the rotation direction A of the rotating hook 3 and/or the second inclined surface 33*a* is formed on the upper surface of the forward side end of the beak body 33 with respect to the rotation direction A of the rotating hook 3, as shown in FIG. 10. Consequently, the protrusion of the bobbin case holder 2 can effectively be prevented from collision against the rotation limiter 12 or thread guide 13 and smoothly pass the rotation limiter 12 or thread guide 13.

Furthermore, the distal edge of the outer peripheral wall 20 facing the enlarged opening 23 serves as a junction to the beak member 5, and a corner appears at the junction, as shown in FIG. 10. Accordingly, there is a possibility that a protrusion of the bobbin case holder 2, that is, the rotation limiter 12 or thread guide 13 may collide against the distal edge of the outer peripheral wall 20 and the distal end of the sliding surface 23 during rotation of the rotating hook 3. In the embodiment, however, the third inclined surface 20*a* is formed on the inner peripheral edge of the outer peripheral wall 20, and the fourth inclined surface 20*b* is formed on the sliding surface 24, as shown in FIG. 10. Consequently, the protrusion of the bobbin case holder 2 can effectively be prevented from collision against the rotation limiter 12 or thread guide 13 and smoothly pass the rotation limiter 12 or the thread guide 13.

According to the foregoing embodiment, the beak member of the rotating hook 3 is made of the synthetic resin and attached to the hook body 4. The first to fourth inclined surfaces 32*a*, 33*a*, 20*a* and 20*b* are formed on the beak member 5 and the outer peripheral wall 20 of the hook body 4. As a result, a smooth rotation of the rotating hook 3 can be ensured since the bobbin case holder 2 is prevented from collision against the rotation limiter 12 or thread guide 13 without fine finishing of the beak member 5 and the hook body 4. Furthermore, since the beak member 5 is made of a synthetic resin into a separate component, the production cost of the rotating hook 3 can be reduced as well as fine finishing of the beak member 5 and the hook body 4 is not necessitated.

The following describes several other embodiments which are partially modified forms of the foregoing embodiment.

Figure 13:
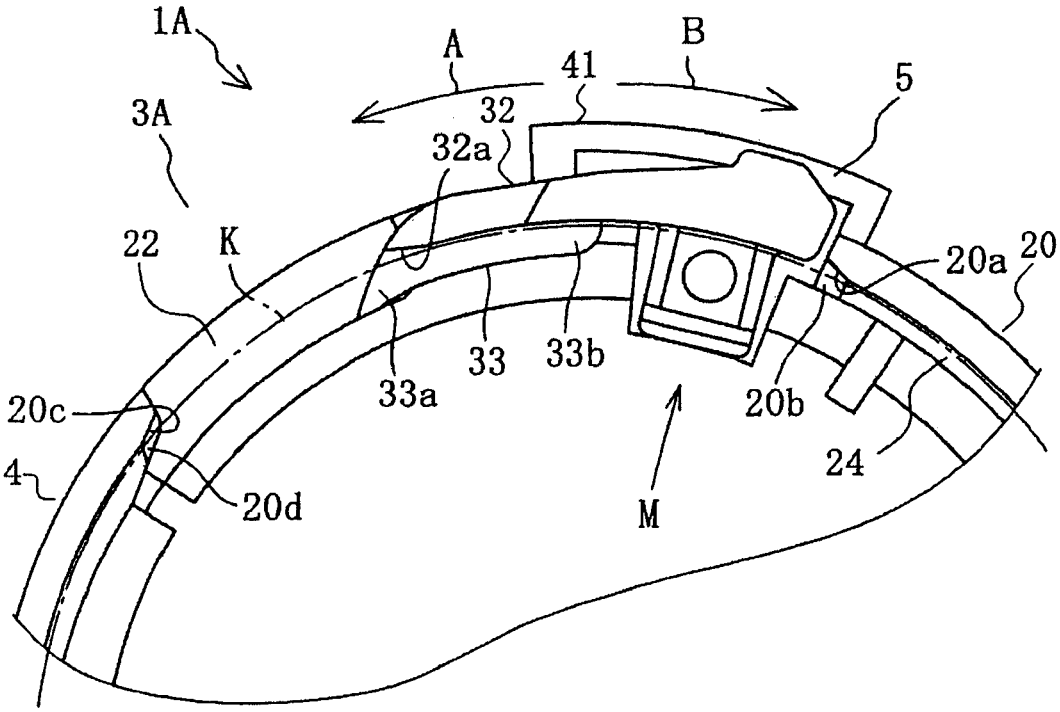
FIG. 13 is a view similar to FIG. 10, showing a second illustrative aspect of the invention.
Figure 14:
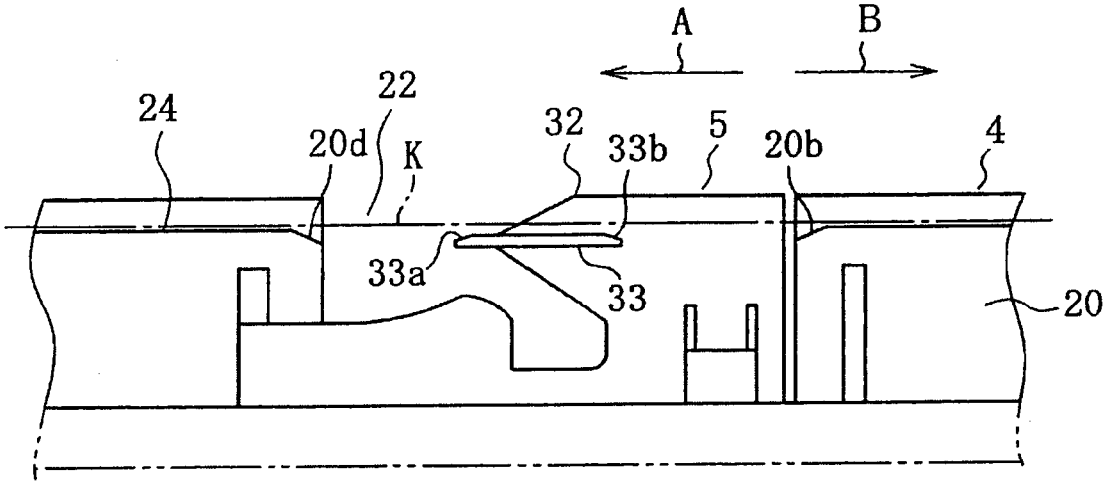
FIG. 14 is a view as viewed in the direction of arrow M in FIG. 13.

FIGS. 13 and 14 illustrate a second embodiment in which the invention is applied to a horizontal half rotary hook 1A, which includes a rotating hook 3 designed to be rotated substantially half turn repeatedly alternately in a normal direction A and a reverse direction B.

In the second embodiment, too, the beak member 5 made of a synthetic resin is mounted, as a separate component, on the hook body 4 (the outer peripheral wall 20). Furthermore, the first to fourth inclined surfaces 32*a*, 33*a*, 20*a* and 20*b* are provided in the same manner as in the first embodiment, as shown in FIG. 12.

The beak body 33 has an end located at a rearward side thereof with respect to the normal rotation direction A as shown in FIG. 13. The end has an upper face formed with a sixth inclined surface 33*b* inclined rearwardly downward with respect to the normal rotation direction A of the rotating hook. Furthermore, as shown in FIGS. 12 and 13, the outer peripheral wall 20 of the rotating hook 3 includes an inner peripheral edge facing a forward side of the opening with respect to the normal rotation direction A of the rotating hook and confronting the beak member 5. The inner peripheral edge of the outer peripheral wall 20 is formed with a seventh inclined surface 20*c* inclined rearwardly outward with respect to the normal rotation direction A of the rotating hook 3. With the seventh inclined surface, the sliding surface 24 has an end facing the needle-thread passing opening 22 and formed with an eighth inclined surface 20*d* inclined rearwardly outward with respect to the normal rotation direction A of the rotating hook 3.

As the result of the above-described construction, the first to fourth inclined surfaces 32*a*, 33*a*, 20*a* and 20*b* prevent the thread guide 13 of the bobbin case holder 2 from collision against the beak member 5 and the outer peripheral wall 20, whereupon smooth rotation of the rotating hook 3 can be ensured. Furthermore, since the sixth to eighth inclined surfaces 33*b*, 20*c* and 20*d* are formed on the beak member 5 and the outer peripheral wall 20, the notch end 14 (see FIG. 3) of the bobbin case holder 2 is prevented from collision against the beak member 5 and the outer peripheral wall 20 when the rotating hook 3 is rotated in the reverse direction B relative to the bobbin case holder 2. Consequently, smooth rotation of the rotating hook 3 can be ensured. Thus, since fine finishing of the beak member 5 and the like is unnecessary, the production cost can be reduced.

Figure 15:
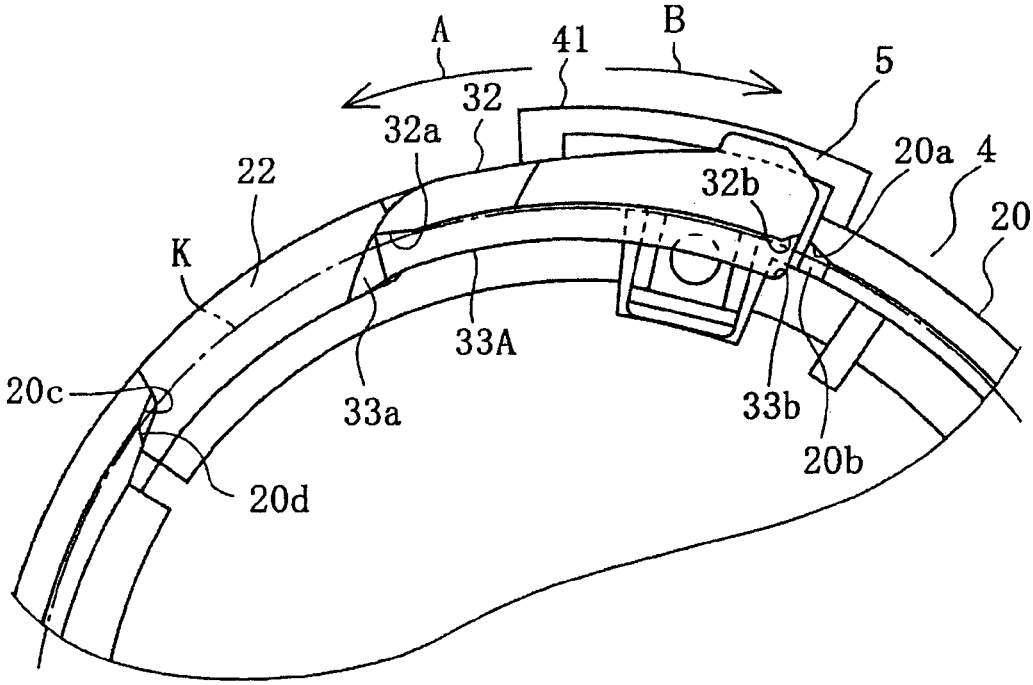
FIG. 15 is a view similar to FIG. 10, showing a third illustrative aspect of the invention.

FIG. 15 illustrates a third embodiment of the invention. The beak member 5 includes a beak body 33A extended to a rearward end thereof with respect to the normal rotation direction A in the third embodiment. The seventh and eighth inclined surfaces 20*c* and 20*d* are provided together with the above-described first to fourth inclined surfaces 32*a*, 33*a*,

20*a* and 20*b*. Additionally, the sixth inclined surface 33*b* is formed on the upper face of the end of the beak body 33A located at the rearward side of the beak body with respect to the normal rotation direction A. The sixth inclined surface 33*b* is inclined rearwardly downward with respect to the normal rotation direction A of the rotating hook 3. Furthermore, a fifth inclined surface 32*b* is formed on an end of the beak peripheral wall 32*b* located at the rearward side of the wall 32*b* with respect to the normal rotation direction A of the rotating hook. The fifth inclined surface 32*b* is inclined rearwardly outward with respect to the normal rotation direction A of the rotating hook 3.

In this case, too, the notch end 14 is also guided by the fifth inclined surface 32*b* when the rotating hook 3 is rotated in the reverse rotation direction B. Accordingly, the collision can be prevented and smooth rotation can be ensured. Since the beak member 5 does not necessitate fine finishing, the production cost can be reduced.

Figure 16:
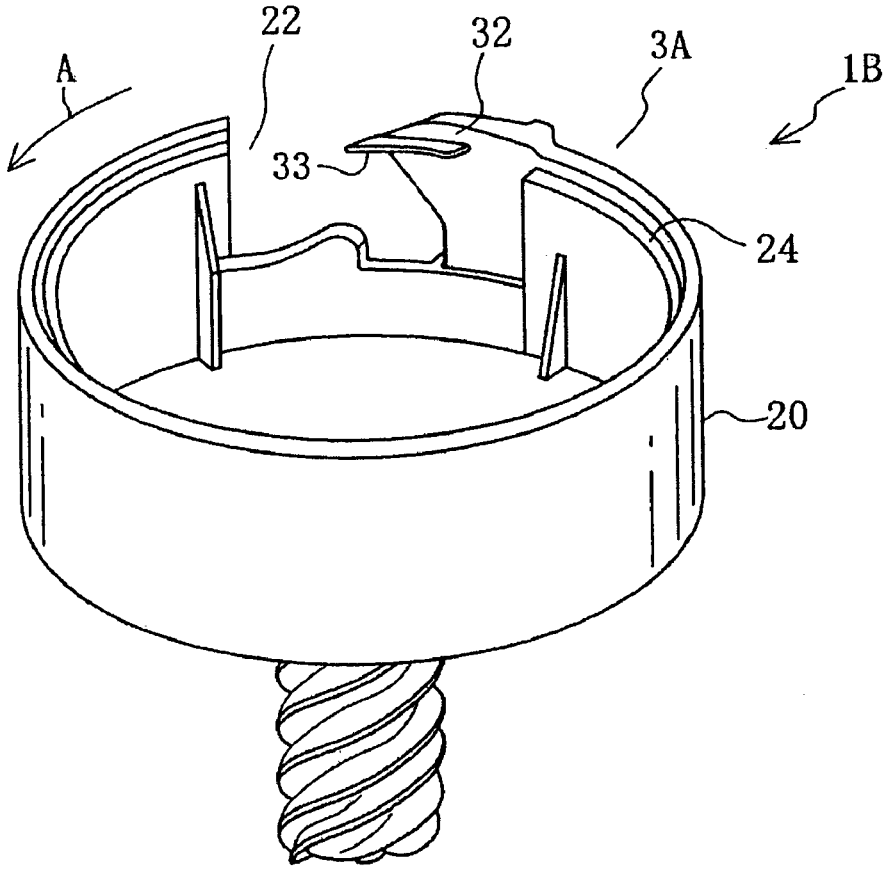
FIG. 16 is a view similar to FIG. 6, showing a fourth illustrative aspect of the invention.
Figure 17:
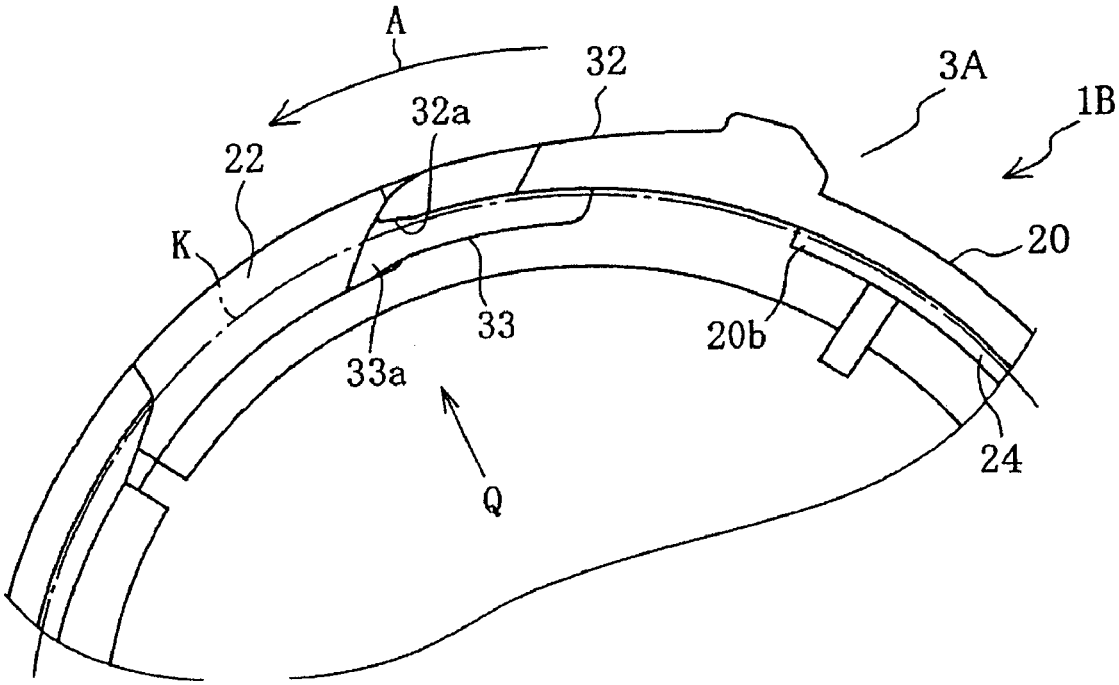
FIG. 17 is a view similar to FIG. 10.
Figure 18:
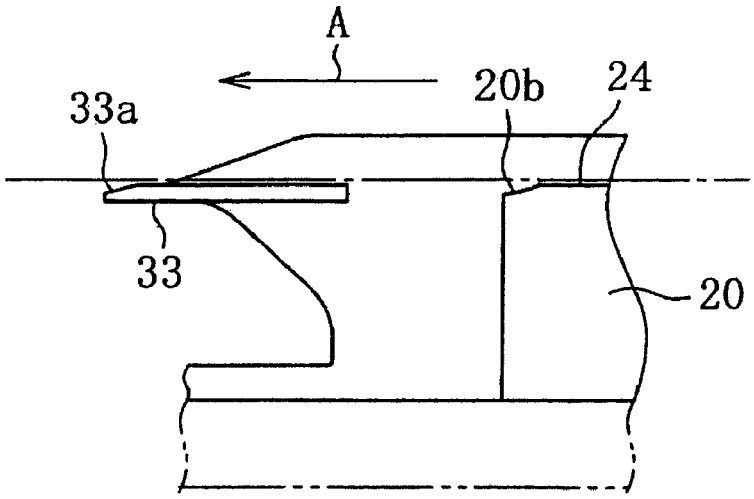
FIG. 18 is a view as viewed in the direction of arrow Q in FIG. 17.

FIGS. 16 to 18 illustrate a fourth embodiment of the invention. A horizontal full rotary hook 1B of the embodiment comprises a rotating hook 3A with an integrally formed beak. More specifically, the beak member 5 is formed integrally with the hook body 4 by injection molding. In this case, the beak peripheral wall 32 and the support wall 31 are formed so as to be continuous to the outer peripheral wall 20.

The first inclined surface 32*a* is formed on the outer peripheral wall 20 (the beak peripheral wall 32) as shown in FIG. 17. The second inclined surface 33*a* is formed on the beak body 33 as shown in FIG. 18. Furthermore, the fourth inclined surface 20*b* is formed on the sliding surface 24.

Accordingly, when the rotating hook 3 is rotated in the rotation direction A relative to the bobbin case holder 2, the thread guide 13 or the rotation limiter 12 of the bobbin case holder 2 can effectively be prevented from collision against the rotating hook 3A and accordingly, smooth rotation can be ensured. Since the rotating hook 3A does not necessitate fine finishing, the production cost can be reduced.

Figure 19:
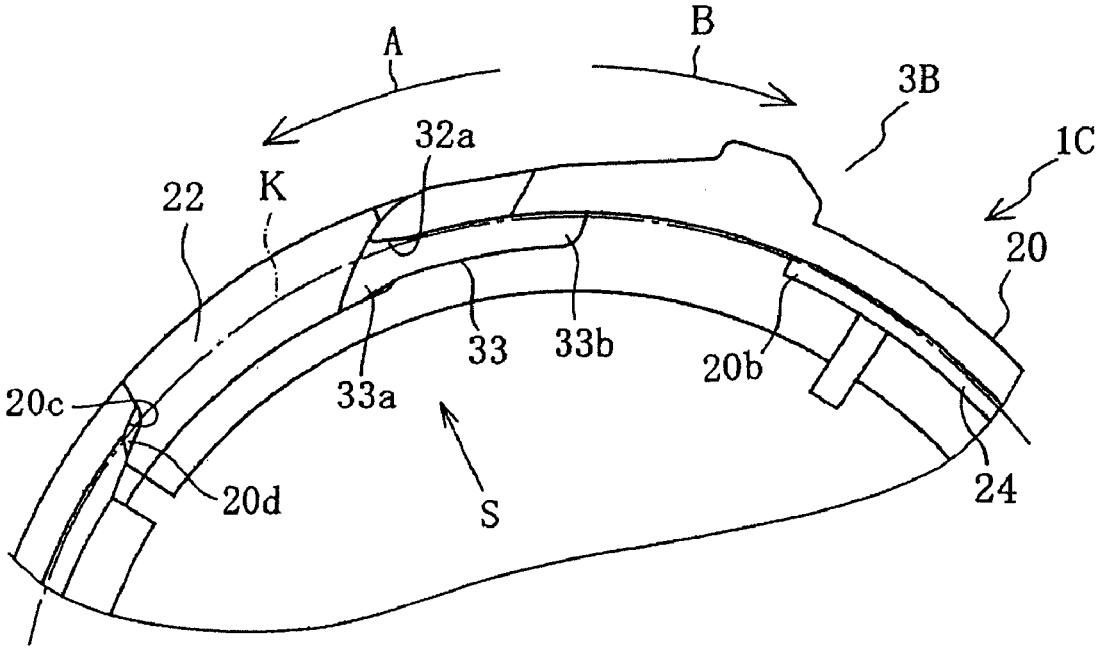
FIG. 19 is a view similar to FIG. 6, showing a fifth illustrative aspect of the invention.
Figure 20:
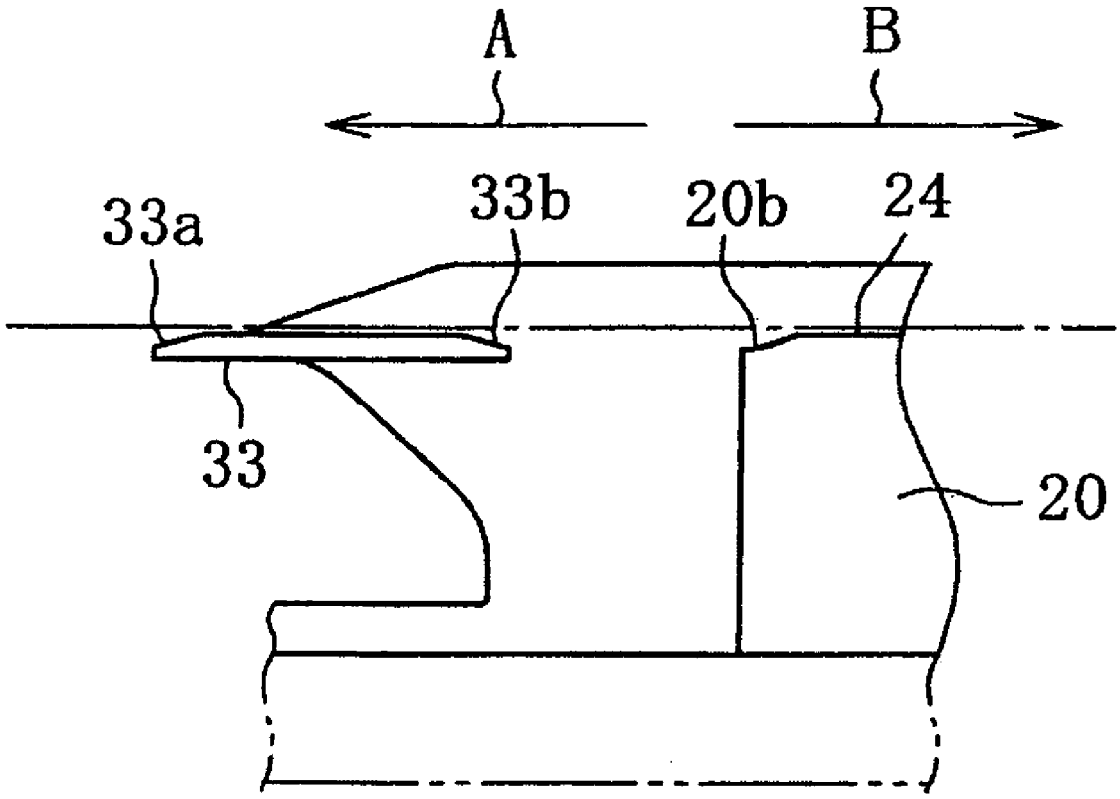
FIG. 20 is a view as viewed in the direction of arrow S in FIG. 19.

FIGS. 19 and 20 illustrate a fifth embodiment of the invention. A horizontal half rotary hook 1C of the embodiment comprises a rotating hook 3B with an integrally formed beak. The beak member 5 is formed integrally with the hook body 4 by injection molding in the embodiment, too. The rotating hook 3B is rotated repeatedly alternately in the normal rotation direction A and the reverse rotation direction B.

The first inclined surface 32*a* is formed on the outer peripheral wall 20 (beak peripheral wall 32) as shown in FIG. 19. The second inclined surface 33*a* is formed on the beak body 33 as shown in FIG. 20. Furthermore, the fourth inclined surface 20*b* is formed on the sliding surface 24.

Additionally, the sixth inclined surface 33*b* is formed on the upper face of the end of the beak body 33 located at the rearward side of the beak body with respect to the normal rotation direction A, as shown in FIG. 20. The seventh inclined surface 20*c* is formed on the inner peripheral edge of the opening 22 of the outer peripheral wall 20 with respect to the normal rotation direction A of the rotating hook 3. Furthermore, the eighth inclined surface 20*d* is formed on the end of the sliding surface 24 facing the forward side of the opening 22 with respect to the normal rotation direction A.

As the result of the above-described construction, when the rotating hook 3B is rotated in the normal rotation direction A relative to the bobbin case holder 2, the thread guide 13 of the bobbin case holder 2 is prevented from collision against the beak body 33 or the outer peripheral wall 20 by the first, second and fourth inclined surfaces 32*a*, 33*a* and 20*b*. When the rotating hook 3B is rotated in the reverse rotation direction B, the notch end 14 of the bobbin case holder 2 is prevented from collision against the beak body 33 or the outer peripheral wall 20 by the sixth, seventh and eighth inclined surfaces 33*b*, 20*c* and 20*d*. Consequently, smooth rotation of the rotating hook 3B can be ensured. Since the rotating hook 3B does not necessitate fine finishing, the production cost can be reduced.

The invention may be applied to various types of horizontal rotary hooks with beaks formed integrally with or separately from the rotating hook 3 respectively.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A horizontal rotary hook for a sewing machine which includes an inner bobbin case holder accommodating a bobbin and having an outer periphery and an outer rotating hook made of a synthetic resin, having an outer peripheral wall and rotated in a predetermined direction while accommodating the bobbin case holder, the horizontal rotary hook comprising:

a sliding surface provided on the rotating hook so as to be slid relative to the bobbin case holder with rotation of the rotating hook while the outer periphery of the bobbin case holder is placed on the rotating hook, the sliding surface having an outer peripheral side;

an opening provided in the outer peripheral wall of the rotating hook so that a needle thread passes therethrough; and a beak provided on the outer peripheral wall of the rotating hook for seizing a loop of the needle thread, the beak including a beak peripheral wall having a distal end located at a forward side of the beak peripheral wall with respect to a rotation direction of the rotating hook, the distal end facing the opening, the beak peripheral wall being located at the outer peripheral side of the sliding surface, the beak further including a beak body formed integrally with the beak peripheral wall and protruding inward from the beak peripheral wall so as to be located in the vicinity of a lower part of the sliding surface, the beak peripheral wall having an inner peripheral surface of the distal end thereof formed with an inclined surface inclined forwardly outward with respect to the rotation direction of the rotating hook wherein the beak member including the beak peripheral wall and the beak body is separate from the rotating hook and detachably attached to the rotating hook, and the beak peripheral wall includes an inner peripheral edge located at a rearward side thereof with respect to the rotation direction of the rotating hook and formed with another inclined surface inclined forwardly outward with respect to the rotation direction of the rotating hook.

2. The horizontal rotary hook according to claim 1, wherein the beak peripheral wall is formed integrally with the outer peripheral wall of the rotating hook.

3. The horizontal rotary hook according to claim 1, wherein the outer peripheral wall of the rotating hook is formed with an enlarged opening which is continuous to a rearward side of the opening with respect to the rotation direction of the rotating hook and on which the beak member is attached, and the outer peripheral wall of the rotating hook has an inner peripheral edge facing the enlarged opening and formed with another inclined surface inclined forwardly outward with respect to the rotation direction of the rotating hook.

4. The horizontal rotary hook according to claim 1, wherein the outer peripheral wall of the rotating hook is formed with an enlarged opening which is continuous to a rearward side of the opening of the rotating hook with respect to the rotation direction of the rotating hook and on which the beak member is attached, and the sliding surface has a distal end facing the enlarged opening and formed with another inclined surface inclined forwardly downward with respect to the rotation direction or the rotating hook.

5. The horizontal rotary hook according to claim 1, wherein the beak body has an end located at a rearward side thereof with respect to the rotation direction of the rotating hook, the end having an upper face formed with another inclined surface inclined rearwardly downward with respect to the rotation direction of the rotating hook.

6. The horizontal rotary hook according to claim 2, wherein the outer peripheral wall of the rotating hook includes an inner peripheral edge facing a forward side of the opening with respect to the rotation direction of the rotating hook and formed with another inclined surface inclined rearwardly outward with respect to the rotation direction of the rotating hook, and the sliding surface has an end facing a forward side of the opening with respect to the rotation direction of the rotating hook and formed with further another inclined surface inclined rearwardly downward with respect to the rotation direction of the rotating hook.

7. The horizontal rotary hook according to claim 1, wherein the outer peripheral wall of the rotating hook includes an inner peripheral edge facing a forward side of the opening with respect to the rotation direction of the rotating hook and formed with another inclined surface inclined rearwardly outward with respect to the rotation direction of the rotating hook, and the sliding surface has an end facing a forward side of the opening with respect to the rotation direction of the rotating hook and formed with further another inclined surface inclined rearwardly downward with respect to the rotation direction of the rotating hook.

8. A horizontal rotary hook for a sewing machine which includes an inner bobbin case holder accommodating a bobbin and having an outer periphery and an outer rotating hook made of a synthetic resin, having an outer peripheral wall and rotated in a predetermined direction while accommodating the bobbin case holder, the horizontal rotary hook comprising:

a sliding surface provided on the rotating hook so as to be slid relative to the bobbin case holder with rotation of the rotating hook while the outer periphery of the bobbin case holder is placed on the rotating hook, the sliding surface having an outer peripheral side;

an opening provided in the outer peripheral wall of the rotating hook so that a needle thread passes therethrough; and a beak provided on the outer peripheral wall of the rotating hook for seizing a loop of the needle thread, the beak including a beak peripheral wall having a distal end located at a forward side of the beak peripheral wall with respect to a rotation direction of the rotating hook, the distal end facing the opening, the beak peripheral wall being located at the outer peripheral side of the sliding surface, the beak further including a beak body formed integrally with the beak peripheral wall and protruding inward from the beak peripheral wall so as to be located in the vicinity of a lower part of the sliding surface, the beak body having a distal end including an upper face formed with an inclined surface inclined forwardly downward with respect to the rotation direction of the rotating hook wherein the beak member including the beak peripheral wall and the beak body is separate from the rotating hook and detachably attached to the rotating hook, and the beak peripheral wall includes an inner peripheral edge located at a rearward side thereof with respect to the rotation direction of the rotating hook and formed with another inclined surface inclined forwardly outward with respect to the rotation direction of the rotating hook.

9. The horizontal rotary hook according to claim 8, wherein the beak peripheral wall is formed integrally with the outer peripheral wall of the rotating hook.

10. The horizontal rotary hook according to claim 8, wherein the outer peripheral wall of the rotating hook is formed with an enlarged opening which is continuous to a rearward side of the opening with respect to the rotation direction of the rotating hook and on which the beak member is attached, and the outer peripheral wail of the rotating hook has an inner peripheral edge facing the enlarged opening and formed with another inclined surface inclined forwardly outward with respect to the rotation direction of the rotating hook.

11. The horizontal rotary hook according to claim 8, wherein the outer peripheral wall of the rotating hook is formed with an enlarged opening which is continuous to a rearward side of the opening of the rotating hook with respect to the rotation direction of the rotating hook and on which the beak member is attached, and the sliding surface has a distal end facing the enlarged opening and formed with another inclined surface inclined forwardly downward with respect to the rotation direction of the rotating hook.

12. The horizontal rotary hook according to claim 8, wherein the beak body has an end located at a rearward side thereof with respect to the rotation direction of the rotating hook, the end having an upper face formed with another inclined surface inclined rearwardly downward with respect to the rotation direction of the rotating hook.

13. The horizontal rotary hook according to claim 9, wherein the outer peripheral wall of the rotating hook includes an inner peripheral edge facing a forward side of the opening with respect to the rotation direction of the rotating hook and formed with another inclined surface inclined rearwardly outward with respect to the rotation direction of the rotating hook, and the sliding surface has an end facing a forward side of the opening with respect to the rotation direction of the rotating hook and formed with further another inclined surface inclined rearwardly downward with respect to the rotation direction of the rotating hook.

14. The horizontal rotary hook according to claim 8, wherein the outer peripheral wall of the rotating hook includes an inner peripheral edge facing a forward side of the opening with respect to the rotation direction of the rotating hook and formed with another inclined surface inclined rearwardly outward with respect to the rotation direction of the rotating hook, and the sliding surface has an end facing a forward side of the opening with respect to the rotation direction of the rotating hook and formed with further another inclined surface inclined rearwardly downward with respect to the rotation direction of the rotating hook.

* * * * *